United States Patent [19]

Larsen

[11] 4,103,272

[45] Jul. 25, 1978

[54] COMBINATION FUSE, ESPECIALLY FOR FIRE PROTECTION INSTALLATIONS

[76] Inventor: Ole Arvid Larsen, Micheletveien 38A, Oslo 10, Norway

[21] Appl. No.: 766,201

[22] Filed: Feb. 7, 1977

[30] Foreign Application Priority Data

Feb. 13, 1976 [NO] Norway ..... 760479

[51] Int. Cl.[2] ..... H01H 37/76; A62C 37/30

[52] U.S. Cl. ..... 337/411; 169/42

[58] Field of Search ..... 337/411, 150; 169/42

[56] References Cited

U.S. PATENT DOCUMENTS

| | | | |
|---|---|---|---|
| 1,167,481 | 1/1916 | Copeland | 169/42 |
| 3,613,795 | 10/1971 | Amicone | 169/42 |

*Primary Examiner*—Harold Broome

*Attorney, Agent, or Firm*—Holman and Stern

[57] ABSTRACT

A combination fuse, especially for fire protection installations. The fuse comprises two metal pieces bonded together by means of a fusible metal which during normal conditions prevents a trip mechanism to be operated. At a temperature above normal ambient temperature the fusible metal loses its bonding effect and permits operation of the trip mechanism. The combination fuse further comprises a heat dissipating means adapted to dissipate heat for raising the temperature of the fusible metal so as to release the combination fuse. The heat dissipation is initiated in response to a signal generated by the sensing of local or remote ambient conditions. The heat dissipating means is an electric resistance element incorporated in a circuit which is electrically separated from the two metal pieces and other components of the fire protection installation. The resistance element is connected in the circuit by members which upon tripping of the combination fuse, i.e., when the fusible metal loses its bonding effect and the two metal pieces are pulled apart by the trip mechanism, ensure the resistance element is disconnected from the circuit for the breaking thereof.

8 Claims, 4 Drawing Figures

COMBINATION FUSE, ESPECIALLY FOR FIRE PROTECTION INSTALLATIONS

BACKGROUND OF THE INVENTION

The present invention relates to a combination fuse, especially for fire protection installations, comprise two metal pieces which normally are bonded together by means of a fusible metal and during normal condition prevent a trip mechanism to be operated, whereas at a temperature above normal ambient temperature the fusible metal losses its bonding effect and releases the trip mechanism, and a heat dissipating means adapted to dissipate heat so as to raise the temperature of the fusible metal for releasing the combination fuse, the heat dissipation being initiated in response to a signal generated by the sensing of local or remote ambient conditions.

In connection with fire protection installations which may include sprinkler devices and/or fire dampers and the like, there may in addition to a local detection and release of the fire protection devices be a demand for remote control of several or groups of such devices. The remote control may be manually initiated from a control station or automatically from detection means responsive to smoke, heat or other ambient conditions and signalling existing or approaching fire. By means of the remote control it is possible selectively to close off the area which is hit or threatend by fire and thus more effectively to utilize the fire protection devices included in larger installations.

The remote control of the devices included in a fire protection installation, has up till now been carried out by means of electro-magnetic components. Such components are very expensive, require a large installation space and suffer from certain drawbacks as regards reliability of operation.

From U.S. Pat. No. 2,272,857 there is known a fuse element which primarily has found application in sprinkler installations. The fuse element is connected to an electric installation by means of two conductors, one of which is connected to the sprinkler head, i.e., the technical installation. The use of the technical installation as a current path is, however, very unfavable, the electrical resistance value given by such an installation being prone to changes, inter alia due to corrosion, and hence very difficult to calculate accurately. In the fuse element according to this patent specification the fuse element proper constitutes the resistance element which, when heated to a desired temperature, will melt the metal of the element. The resistance of the fuse element will together with the resistances afforded by the technical installation and the transition resistances therebetween, give a measure for the voltage necessary to be applied in order to pass through the fuse element a current having an intensity sufficient for making the fusion metal lose its holding ability. In practice this involves such a high voltage that special precautions have to be taken for protection against touch.

In GB Pat. No. 1,406,677 there is disclosed a fuse element which like the fuse element according to the patent specification discussed above, finds application in sprinkler installations. The fuse element according to GB Pat. No. 1,406,677 comes into operation when the ambient temperature exceeds a given value, and comprises heat generating means which in response to an electric signal blows an open flame towards the fusible metal of the fuse element so as to deprive it of its holding ability. However, the fuse according to GP Pat. No. 1,406,677 does not render any possibility of checking whether or not the fuse element is intact.

From G Pat. No. 1,363,945 there is known a fuse element consisting of two rupturable bulbs which in addition to being ruptured due to an increased ambient temperature, may also be ruptured by means of a piston-operated striker which is discharged towards the bulbs by means of an explosive charge which is ignited by an electric pulse.

In U.S. Pat. No. 3,897,828 there is described a fuse element consisting of two metal pieces which are bonded together by a fusible metal, which during normal conditions prevents a trip mechanism from being actuated. The known element comprises a filament which may be a single or multi-stranded lead passing from an area to be protected by the fire extinguishing apparatus holding the fuse element. Thus, the fuse element according to U.S. Pat. No. 3,897,8282 is involved in a direct transfer of heat via a conductor from a heated area to the element, the heat being transferred via the filament.

Finally, from U.S. Pat. No. 1,029,277 there is known a fire extinguishing apparatus comprising a heat filament which is connected to a current source by two leads. The one lead is, however, connected to ground, and also in such a fire extinguishing apparatus, one will encounter the same problems with respect to incalculable resistance of the current path as discussed above in connection with U.S. Pat. No. 2,272,857.

SUMMARY OF THE INVENTION

An object of the present invention is to provide a combination fuse which does not exhibit the disadvantages associated with known fuse elements.

Another object of the present invention is to provide a fuse element which, when incorporated in a remote-controlled fire protection system, can very easily be supervised.

Still another object of the present invention is to provide a fuse element which is reliable and is easy and economic to manufacture.

According to the invention, in a combination fuse as defined in the preamble, these objects are achieved due to the fact that the heat dissipating means is an electric resistance element incorporated in a circuit which is electrically separated from said two metal pieces and the other components of the fire protection installation, and that the resistance element is connected in the circuit by members which upon tripping of the combination fuse ensure that the resistance element is disconnected from the circuit for the breaking thereof.

In a first embodiment of the fuse according to the invention the members may constitute a first clamping member attaching the resistance element to the one of said metal pieces and a second clamping member attaching the lead ends connecting the resistance element in said circuit to the second of said metal pieces.

In a second embodiment of the fuse according to the invention the members may comprise elastic metal parts which upon trigging of the combination fuse, i.e., when the fusible metal loses its bonding ability, and the two metal pieces are pulled apart by the trip mechanism, whip the resistance element out of the circuit for the breaking thereof.

The circuit including the resistance element, may be closed in response to a signal from a smoke detector placed in a strategic location. The smoke detector may then send a signal directly to the apparatus in which the combination fuse is mounted, or it may send a signal to a central control desk which then transmits a signal to one or more preselected apparatus. Apart from being tripped in response to a signal from a smoke detector, the combination fuse according to the invention may also be trigged in response to a manual signal generated in the said central control desk. However, in both cases the combination fuse may be tripped by local excessive heat, i.e., it is capable of being tripped thermally at the threatened location in addition to be tripped due to other local or remote conditions.

In the present combination fuse the difficulties referred to above with respect to an incalculable overall resistance of the current path are avoided. According to the invention, the fuse is designed with a separate electric resistance element incorporated in a circuit which is electrically separated from the two metal pieces and which serve to generate heat in the resistance element only when it is desired to induce a tripping of the fuse from a remote location. The resistance element may be chosen among standard components having known characteristic electric data and may be connected to a low voltage system directly via the supply leads. Thus, by means of the fuse element according to the present invention there is achieved a well defined connection having easily determinable data which change very little with time.

By providing the combination fuse with members which upon tripping of the combination fuse remove the resistance element from the circuit in which it is connected, it is possible with the use of appropriate control means easily and rapidly to check whether or not the fuse is intact. The breaking of the current circuit through the electric resistance element will taken place at the tripping of the fuse either the tripping is due to excess ambient temperature, current through the element or malicious damage, and by testing the current path in which the element is incorporated a reliable indication may be achieved as regards whether the fuse has been operated or is still intact. Such a test may easily be accomplished from a central testing or supervising station. For this purpose a test current is passed through the circuit comprising the resistance element, which current is too small for heating the resistance element, if still in the circuit, to an extent sufficient for causing a risk of tripping. If the circuit through the element is broken, this indicates that the fuse has operated and that the trip mechanism in which the fuse is mounted, has been released.

The invention will in the following be described in further details, reference being had to the drawings, which illustrate two embodiments of the combination fuse according to the invention.

DETAILED DESCRIPTION OF PREFERRED EMBODIMENTS

Figure 1:
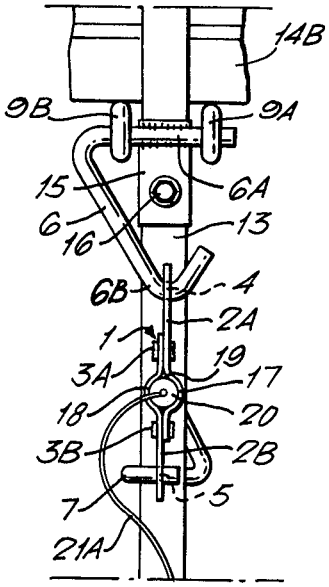
FIG. 1 is a side view of a combination fuse according to the invention, clamped in a holding device included in a fire damper.
Figure 2:
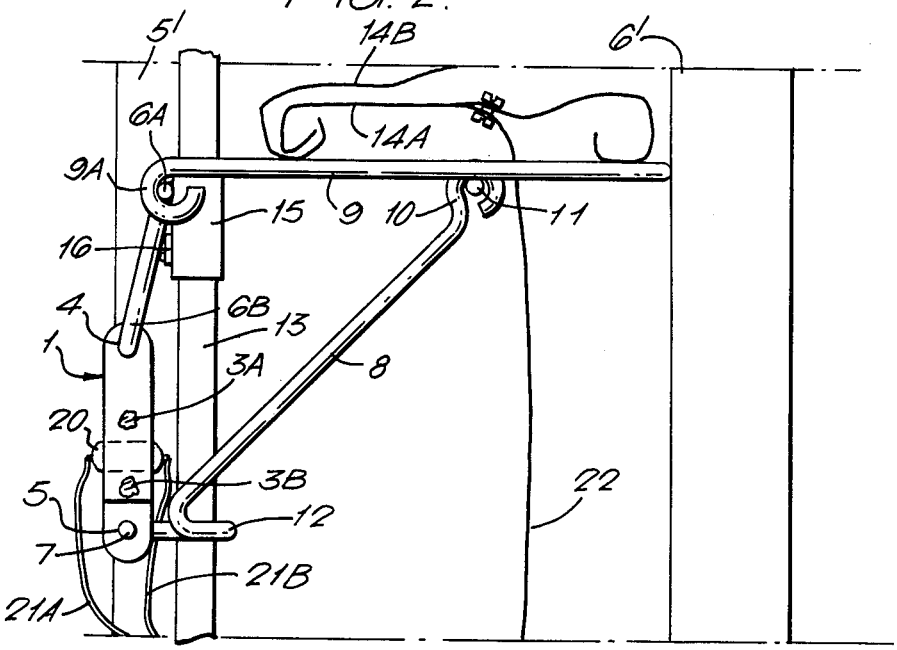
FIG. 2 is a front view of the combination fuse and the other parts appearing in FIG. 1.

In FIGS. 1 and 2, 1 designates the actual combination fuse. It consists of two metal pieces 2A and 2B bonded together by a soldering metal which melts at a certain high temperature. The alloy of the soldering metal is adapted to the temperature at which the combination fuse 1 is to be released, and which may be 50°, 63°, 74°, 93° or 120° C, depending on the existing conditions and the regulations which have to be complied with at the place of installation. The soldering of the two metal pieces 2A, 2B may for example be carried out by filling two pairs of matching holes in the metal pieces with the soldering metal. These soldering points are indicated at 3A and 3B in FIGS. 1 and 2. At their ends the metal pieces 2A and 2B are provided with holes 4 and 5, respectively, by means of which they may be hooked onto a fuse holder, for example of the type which is disclosed in Norwegian patent application No. 75 3213, and which may be mounted in a louver fire damper to keep the louver boards in an arbitrary open position. In FIG. 2 the front and rear frames of the fire damper are indicated at 5′ and 6′, respectively. The holes 4 and 5 in the metal pieces 2A and 2B are hooked onto lower end portions 6B and 7 of a fuse affixing means 6 and a brace 8, respectively. At the top the brace 8 has a curved end portion 10 gripping around a pivot constituted by a cross-bar 11 of a supporting hoop 9. The lower portion 12 of the brace 8 is bent so as to engage a hollow rod or pipe 13, and continues therefrom to the end portion 7 engaging the metal piece 2B as described.

In a manner disclosed in Norwegian patent specification No. 75 3213, the complete fuse holder with the combination fuse 1 can be inserted in the front frame 5′ of the fire damper, the legs of the hoop 9 have curved end portions 9A with which it is pivotally supported on an upper end portion 6A of the affixing means 6, and during normal conditions, i.e., with the damper open as indicated in FIGS. 1 and 2, the supporting hoop 9 will extend approximately horizontally and substantially throughout the entire width of the damper so as to support the louver boards 14A, 14B included in the fire damper. The portion 6A of the affixing means 6 is welded to a sleeve 15 which may be displaced along the rod 13 and be attached thereto by means of an umbraco screw 16. The lower end portion 6B of the affixing means 6 is shaped as a hook for engaging the combination fuse 1 mentioned above.

Each of the metal pieces 2A and 2B is manufactured from a substantially rectangular blank and in an intermediate area they are shaped with an arched portion 17 and 18, respectively, which upon assembly of the two pieces 2A and 2B define a cylindrical space 19 serving to accomodate a resistance element 20. The resistance element 20 is connected to conductors 21A and 21B, which in turn may be included in a circuit capable of being closed, e.g., in response to a signal from a local or remote smoke detector or the like.

The conductors 21A and 21B may conveniently be passed along the rod 13 and, in the area of attachment of the lower end of the rod on the front damper frame 5′, be connected to connection means attached thereto, for example by plug connections. The connection means may in turn be connected to a 24 Volt DC or AC circuit which will be closed at given conditions, as explained above. Thus, the complete fuse holder with the combination fuse already mounted therein can be placed in position in the damper, whereafter the connection of the conductors 21A and 21B is accomplished. Of course, the conductors 21A and 21B may be protectively located inside the hollow rod or pipe 13, which would require appropriate openings to be made in the pipe 13.

During normal operation the damper boards 14A, 14B etc. will be completely or partly folded together, as indicated in FIG. 2, by being supported by the supporting hoop 9 which in turn is supported by the brace 8 kept in position by the combination fuse 1, which connects the brace 8 with the affixing means 6. By excessive local temperature, e.g., during fire, the soldering metal 3A and 3B will melt, with the result that the metal pieces 2A and 2B of the combination fuse will be disconnected from each other, whereby the supporting hoop 9 and the brace 8 will collapse along the rod 13. The damper louvers 14A, 14B, etc., will then under the influence of their own weight and possibly of the pulling force from a spring 22 unfold and snap into a closing position (not shown). Suitable locking means will be used for locking the fire damper in this closed position as described in more detail in Norwegian patent specification No. 75 3213. The spring 22 of which only a part is shown in FIG. 2, may be a coiled spring which, when uncoiled, exerts a given pulling force on the lowermost damper louver 14A.

However, the combination fuse will not only respond to abnormally high temperatures which might have been caused by a fire approach. For example, it is also possible by connecting the resistance element 20 in a circuit which is closed in response to a signal from a strategically located detector, to make the fuse be released in response to other conditions than a direct excessive local temperature. Thus, the conductors 21A and 21B may be incorporated in circuits which include local and remote smoke detectors and the like, or it may be connected to a local control station transmitting signals selectively operating the above-described combination fuse so as to achieve a selective limitation of the area which is on fire or which might be threatened by a possible fire.

The combination fuse according to the invention may conveniently be adapted to cause automatic interruption of the current when the fuse is tripped due to heating of the resistance element.

In the embodiment illustrated in FIGS. 1 and 2 this may be done with appropriate clamping means, said means clamping the resistance element to the upper metal piece 2A which is hooked onto the affixing means 6, and clamping the ends of the conductors 21A and 21B to the lower metal piece 2B hooked onto the brace 8. When the combination fuse 1 is released either by heat due to local fire, by heat generated by the resistance element 20 or by malicious damage, not only the metal pieces 2A and 2B will be pulled apart, but simultaneously also the ends of the conductors 21A and 21B will be pulled off from the resistance element 20. Thus, an operation of the combination fuse will automatically break the circuit in which the resistance element 20 is included. The circuit may easily be checked by trying to send a signal therethrough. A signal which comes through will then indicate that the fuse is still intact, whereas absence of the signal will indicate a tripped fuse.

Figure 3:
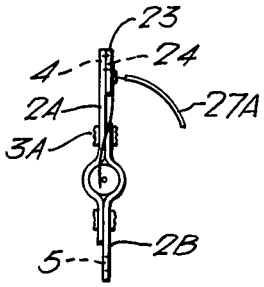
FIG. 3 is a side view of a second and preferred embodiment of the combination fuse according to the invention.
Figure 4:
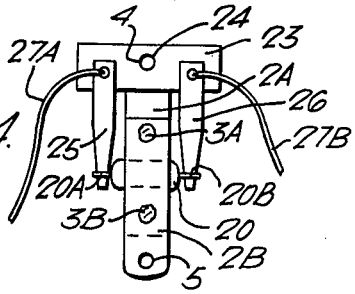
FIG. 4 is a front view of the embodiment of FIG. 3.

In FIGS. 3 and 4 there is illustrated another embodiment of the combination fuse according to the invention. This embodiment is in principle constructed in the same manner as the embodiment according to FIGS. 1 and 2, but comprises a transverse piece 23 of electrically insulating material provided on the metal piece 2A. The transverse piece 23 is provided with a central hole 24 registering with the hole 4 in the metal piece 2A, and is at each end provided with a flat, resilient metal member or spring member 25 and 26, respectively. At the ends attached to the transverse insulating piece 23 the spring members 25 and 26 are provided with connection points for electric conductors 27A and 27B. At their other ends the spring members 25 and 26 make resilient contact with the resistance element 20, said spring members having an elongated shape with a slight S-like curvature from the transverse piece 23 to the connection points 20A and 20B, respectively, of the resistance element 20. Upon tripping of the combination fuse, i.e., when the fusible metal 3A, 3B loses its holding ability and the two metal pieces 2A, 2B are pulled apart by a trip mechanism such as that discussed in connection with FIGS. 1 and 2, and which is affixed by means of the combination fuse at the holes 4 and 5, the spring members 25 and 26 will whip the resistance element away so as to cause breaking the current through the element.

In the embodiment in FIGS. 3 and 4 the connection points 20A and 20B of the resistance element may be affixed to the spring members 25 and 26 by a fusible metal having substantially the same melting temperature as the fusible metal 3A and 3B. When voltage is applied to the resistance element 20, i.e., when the conductors 27A and 27B are incorporated in a closed circuit and thereby pass current through the spring members 25 and 26 so as to develop heat in the resistance element 20, both the fusible metal 3A and 3B in the metal pieces 2A and 2B and the fusible metal at the connection points 20A and 20B will melt. The metal pieces 2A and 2B will then be separated from each other by the trip mechanism described above, and the springs 25, 26 will whip the resistance element 20 off and thereby break the circuit therethrough.

Voltage may be applied to the resistance element 20 from a central smoke detector station which for example supplies voltage of 24 V at given conditions, or the resistance element 20 may be placed under tension by means of a smoke detector which is placed at a strategic location, and which closes an electric circuit including the resistance element without first having to give a signal to the central smoke detector station. The voltage may also be remotely controlled from a manually operated station if it is desired to provide for a manual control of a fuse means which in addition may be tripped due to local thermal conditions.

By providing the combination fuse according to the invention with members which by operation of the fuse ensure removal of the resistance element from the circuit path when the fuse parts are pulled apart, it is possible with simple means to check whether the fuse has been operated or is still intact. Through the circuit including the resistance element there may for example be sent a test current which is so low that the resistance element, if it still should be connected in the circuit, is not heated to an extent entailing a danger of tripping the fuse. If the circuit comprising the element is broken, this indicates that the fuse has been tripped either due to an excess ambient temperature, a controlled current through the element or other irregular conditions, such as malicious damage. To make sure that even in connection with malicious damage the resistance element is pulled off from the resilient conducting metal members when these are attached to the connection points of the resistance element by a fusible soldering metal, a clamping means serving to attach the resistance element to the metal piece which is not carrying the elastic metal members, may suitably be provided. The clamping means will then make sure that the resistance element is pulled out of the circuit for breaking the same when the metal pieces of the fuse bonded together by the fusible metal are pulled or hammered apart even if heating of the fusible metal has not taken place.

When the resistance element is attached to one of the metal pieces by a clamping device, the spring members will still contribute in an effective separation of the resistance element from the connection points of the spring members, especially when the fuse is operated in response to local heating either by a local fire or by current flowing through the resistance element.

if desired, the use of a fusible metal at the connection points may be omitted.

As mentioned above the combination fuse according to the invention may be utilized in connection with fire protection installations including sprinkler systems and/or fire dampers. A fire protection installation may also comprise smoke hatches, smoke gas dampers and fire doors, and it is to be understood that the combination fuse may also be used in connection with the functions associated with the opening and closing of such installed apparatus. It is also to be understood that a combination fuse may be used as a fuse or trip element in general, if it under normal conditions is desired to have an element which has a large holding capacity, and which can rapidly be released by a signal initiated by local or remote conditions.

The combination fuse according to the invention provides a large pulling force and may even if made with small dimensions be loaded very heavily. The mounting space required by the combination fuse as compared to electro-magnetic holding means is very small, and the combination fuse according to the invention is both simple and economic to manufacture. The combination fuse may be connected to a low voltage system having an operational voltage of approximately 20 - 30 V, which for most installations does not require any special precautions as regards protection against touch.

By adapting the resistance element to the voltage of operation, there may be achieved a combination fuse which has a release time of a few seconds.

What I claim is:

1. A combination fuse, especially for fire protection installations, comprising two metal pieces (2A, 2B) which normally are bonded together by means of a fusible metal (3A, 3B) and during normal condition prevent a trip mechanism to be operated, whereas at a temperature above normal ambient temperature the fusible metal loses its binding ability and releases the trip mechanism, and a heat dissipating means adapted to dissipate heat to raise the temperature of the fusible metal for releasing the combination fuse, the dissipation of heat being initiated in response to a signal generated by the sensing of local or remote ambient conditions, characterized in that the heat dissipating means is an electric resistance element (20) incorporated in a circuit which is electrically separated from the two said metal pieces (2A, 2B) and the other components included in the fire protection installation, and that the resistance element (20) is connected in the circuit by members which upon tripping of the combination fuse ensure that the resistance element is disconnected from the circuit for the breaking thereof.

2. A fuse as claimed in claim 1, characterized in that the members constitute a first clamping member attaching the resistance element to the one of said metal pieces and a second clamping member attaching the lead ends connecting the resistance element in said circuit to the second of said metal pieces.

3. A fuse as claimed in claim 1, characterized in that said members are resilient metal members which upon tripping of the combination fuse (1), i.e., when the fusible metal loses its bonding ability and the two metal pieces (2A, 2B) are pulled apart by the trip mechanism, whip the resistance element (20) out of the circuit for breaking the same.

4. A fuse as claimed in claim 3, characterized in that the two metal pieces 2A, 2B) are made of substantially rectangular blanks and in a central area have an arcuate portion (17, 18) which upon assembly of pairs of pieces form a pocket (19) for holding the resistance element (20), and that to one of said two metal pieces (2A) there is attached a third, transverse piece (23) of electrically isolating material which at either end carries said resilient metal members (25, 26), and that at the end attached to the transverse piece (23) said metal members are provided with connection points for electric leads (27A, 27B) and at the other end make spring loaded contact with the resistance element (20) held by the said one metal piece (2A).

5. A fuse as claimed in claim 4, characterized in that the connection points (20A, 20B) of the resistance element (20) are attached to the spring members (25, 26) by means of a fusible metal.

6. A fuse as claimed in claim 4, characterized in that the resistance element (20) is attached to the one of said two metal pieces which does not carry the third, transverse piece (23) carrying the resilient metal members (25, 26).

7. A fuse as claimed in claim 1, characterized in that a first current source is adapted to be connected in the circuit in response to the signal generated by the sensing of the local or remote ambient conditions for the heating of the resistance element (20) and hence the fusible metal (3A, 3B), and that a second current source is included in the circuit and during normal condition is driving a small signal current through a current path closed by said resistance element, said signal current only serving to supervise the condition of the combination fuse and being too small for heating the element to an extent sufficient for causing tripping of the combination fuse.

8. A fuse as claimed in claim 7, characterized in that the path of the signal current includes a warning device responsive to the discontinuation of the signal current through the resistance element, i.e., to a released trip mechanism.

* * * * *